United States Patent [19]

Youngeberg et al.

[11] Patent Number: 5,044,555

[45] Date of Patent: Sep. 3, 1991

[54] SELF-CLEANING SOLENOID CONTROLLED WATER SPRAY NOZZLE AND VALVE ASSEMBLY

[75] Inventors: Judy L. Youngeberg, Manheim; Richard A. Colberg, Lancaster, both of Pa.

[73] Assignee: Herrmidifier Company, Inc., Lancaster, Pa.

[21] Appl. No.: 555,615

[22] Filed: Jul. 23, 1990

[51] Int. Cl.[5] ..... B05B 15/02

[52] U.S. Cl. ..... 239/117; 239/462; 239/493; 239/575; 239/583; 222/149; 137/244; 137/549; 251/129.15

[58] Field of Search ..... 239/114–117, 239/123, 462, 463, 486, 493, 575, 583; 222/149, 504; 137/244, 549; 251/129.15

[56] References Cited

U.S. PATENT DOCUMENTS

| | | | |
|---|---|---|---|
| 1,289,234 | 12/1918 | Nitz | 239/117 |
| 1,953,990 | 4/1934 | Roselund | 239/117 |
| 2,218,446 | 10/1940 | Wright | 137/549 |
| 2,258,230 | 10/1941 | Warren | 137/549 |
| 2,825,602 | 3/1958 | Rabbitt | 239/117 |
| 2,973,004 | 2/1961 | Jones | 251/333 |
| 3,565,052 | 2/1971 | Wallace | 236/44 |
| 3,804,388 | 4/1974 | Jamell | 239/117 |
| 4,360,156 | 11/1982 | Soth et al. | 239/462 |
| 4,697,608 | 10/1987 | Kolze et al. | 251/129.15 |

FOREIGN PATENT DOCUMENTS

| | | | |
|---|---|---|---|
| 412491 | 11/1966 | Switzerland | 137/244 |

*Primary Examiner*—Andres Kashnikow
*Assistant Examiner*—Karen B. Merritt
*Attorney, Agent, or Firm*—Brady, O'Boyle & Gates

[57] ABSTRACT

A self cleaning solenoid controlled water spray nozzle and valve assembly including an adaptor connected at one end to a solenoid actuated valve member and having a nozzle and nozzle flow direction member connected to the opposite end of the adaptor. A cleaning pin is connected to the valve member and extends through the nozzle orifice. In one embodiment the nozzle is integrally formed with the adaptor and the flow direction member is integrally formed on the bottom wall of a cup positioned within the adaptor. In another embodiment the nozzle and associated flow direction member are threadably mounted on the adaptor.

14 Claims, 3 Drawing Sheets

SELF-CLEANING SOLENOID CONTROLLED WATER SPRAY NOZZLE AND VALVE ASSEMBLY

BACKGROUND OF THE INVENTION

Self cleaning water spray nozzles and valve assemblies have been employed for use particularly in humidification systems and humidifiers as evidenced by U.S. Pat. No. 2,825,602, dated Mar. 4, 1958, wherein a stem is connected at one end to a diaphragm and a thin needle or wire is connected to the opposite end of the stem and extends through the nozzle aperture to prevent the build-up of minerals therein. A valve head is mounted on the intermediate portion of the stem and adapted to engage a valve seat positioned in the nozzle, whereby the diaphragm actuates the stem and associated valve to control the water flowing axially through the nozzle.

Water spray nozzles having solenoid actuated valve assemblies have also been employed, as disclosed in U.S. Pat. No. 3,565,052, dated Feb. 23, 1971, wherein a valve is disposed between a nozzle and a solenoid, whereby the valve is actuated by the solenoid to control the flow of water through the nozzle.

SUMMARY OF THE INVENTION

After considerable research and experimentation, the self cleaning solenoid controlled water spray nozzle and valve assembly of the present invention has been devised to include, in one unit, the self cleaning feature, and the solenoid actuated valve feature of the prior art.

The apparatus of the present invention comprises, essentially, a cylindrical adaptor having an integral yoke member formed on the outer wall surface thereof and connectable at one end to a solenoid. An integral water inlet fitting is formed on the adaptor wall portion, and a nozzle portion is connected to the opposite end of the adaptor. In one embodiment, the nozzle portion is formed integral with the adaptor, and in another embodiment, the nozzle is threadably connected to the adaptor. A nozzle flow direction member is positioned within the nozzle portion, and a valve seat is positioned within the adaptor. In one embodiment, the valve seat is formed integral with the nozzle flow direction member, and in the other embodiment, the valve seat is formed integral with the adaptor. A resilient valve member is mounted on the end of the solenoid armature or plunger which is spring biased in a direction to close the valve member against the valve seat, and a thin needle extends from the valve member through the valve seat, nozzle flow direction member and nozzle aperture, to thereby prevent the nozzle from becoming clogged with accumulated minerals from the water spray. To further prevent the entrance of dirt into the nozzle, a strainer is positioned within the adaptor on the inlet side of the valve seat.

By forming the various components of molded plastic, the formation of rust is prevented, and where the components are not formed from plastic, stainless steel is employed.

DESCRIPTION OF THE PREFERRED EMBODIMENT

Figure 1:
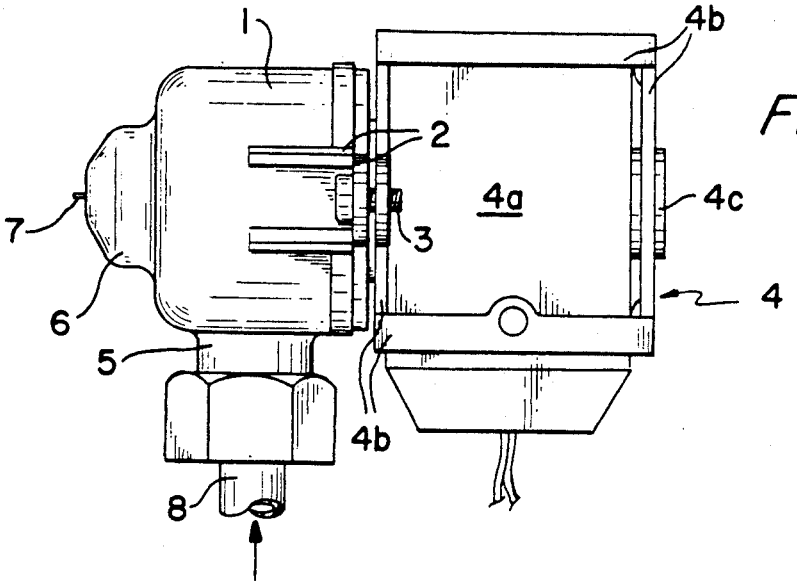
FIG. 1 is a side elevational view of one embodiment of the self cleaning solenoid controlled water spray nozzle and valve assembly of the present invention.

Referring to the drawings in greater detail, and more particularly to FIG. 1, the self cleaning solenoid controlled water spray nozzle and valve assembly of the present invention comprises a cylindrical adaptor 1 having an integral yoke member 2 formed on the outer wall surface thereof and connectable by suitable screws 3 to a solenoid valve 4. An integral water inlet fitting 5 is provided on the adaptor wall portion and a nozzle portion 6 is formed integral with the adaptor 1. A thin needle or wire 7 extends through the nozzle aperture and is operably connected to the solenoid valve 4 to be described more fully hereinafter, whereby the nozzle aperture is prevented from becoming clogged by accumulated minerals from the spray water.

Figure 2:
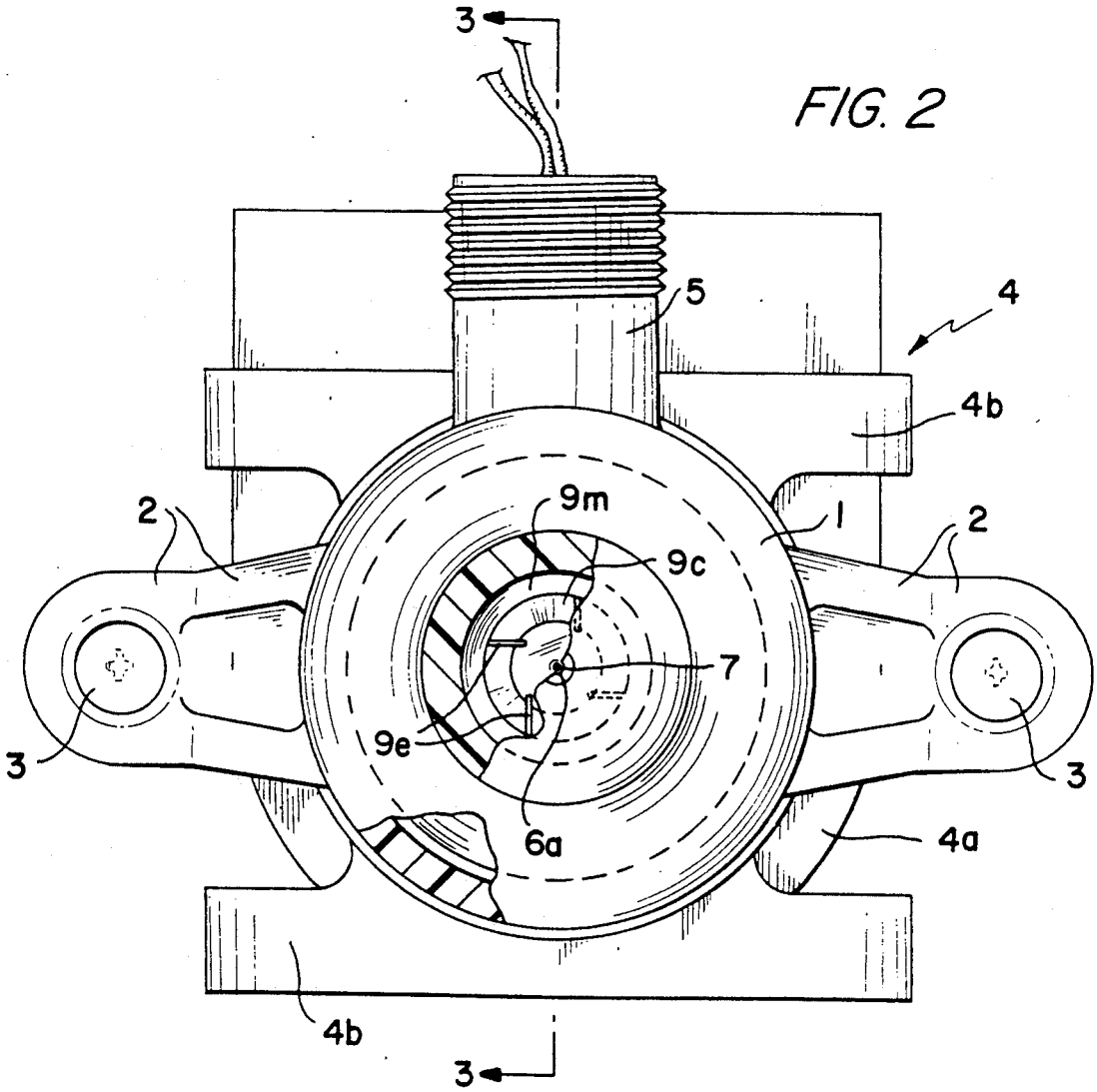
FIG. 2 is an enlarged fragmentary, sectional end view of the apparatus shown in FIG. 1.
Figure 3:
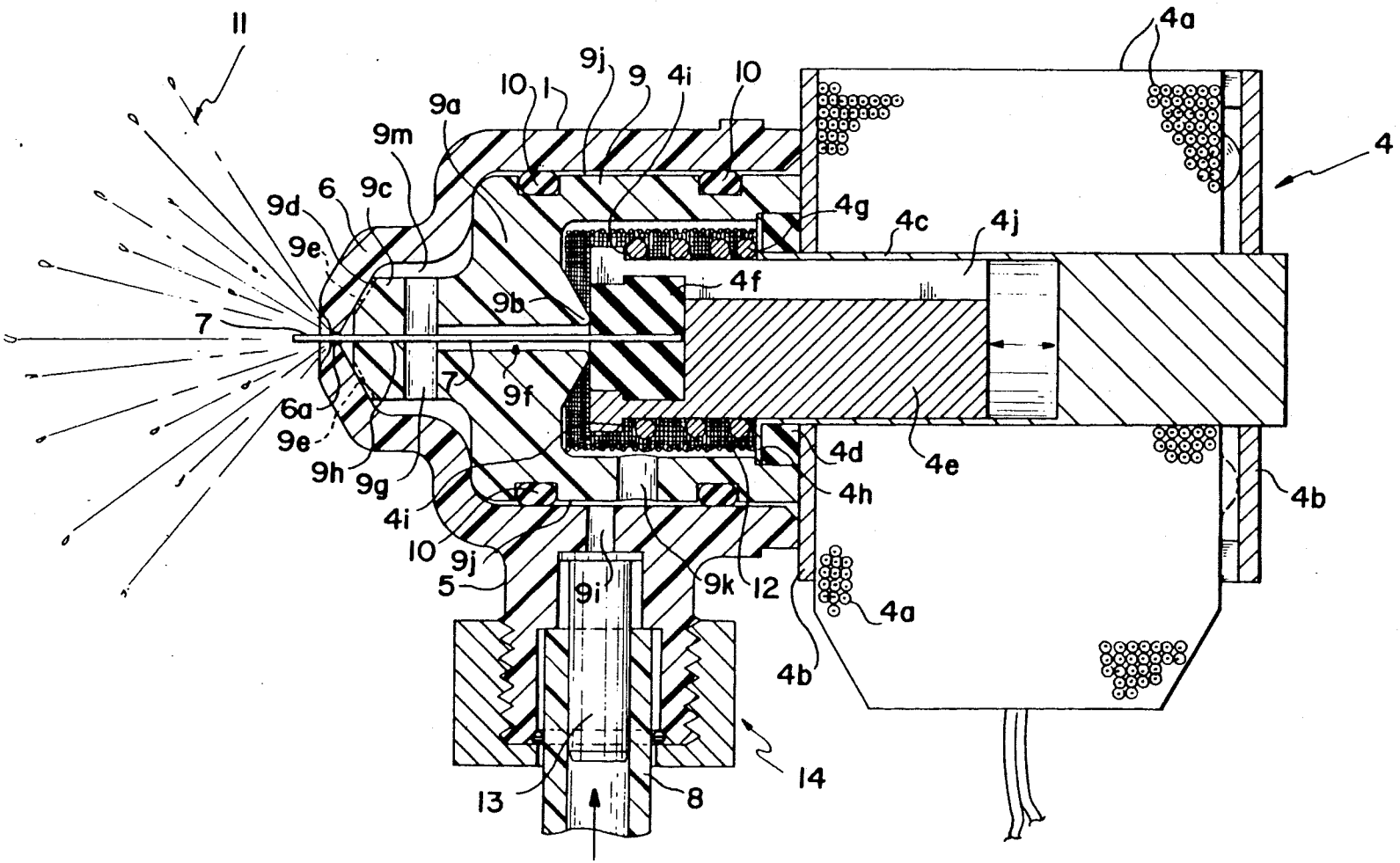
FIG. 3 is a longitudinal sectional view taken substantially along line 3—3 of FIG. 2.

The details of the construction of the apparatus shown in FIG. 1 are illustrated in FIGS. 2 and 3. While FIG. 1 shows the adaptor 1 connected to the solenoid valve 4 in one position wherein the water supply pipe 8 extends upwardly toward the inlet fitting 5, on the same side of the assembly as the power input conductors for the solenoid, the adaptor 1 and yoke member 2 can be rotated 180° relative to the solenoid 4 and the yoke member 2 connected to the solenoid valve 4 with the screws 3 so that the fitting 5 is oriented for connection to a water supply pipe (not shown) on the opposite side of the assembly from the solenoid power input conductors.

The solenoid valve 4 is of a type manufactured by the Automatic Switch Co. (ASCO) of Florham Park, New Jersey, Model No. 8261, and comprises an electrical coil **4*a* mounted within a frame 4*b*. An armature cup 4*c* is fixedly mounted within the coil 4*a* and is provided with a watertight seal 4*d* between its open end and the frame 4*b*. An armature or plunger 4*e* is slidably mounted in the armature cup 4*c* and is provided with a resilient valve head 4*f* at one end thereof. A coil spring 4*g* is positioned between an outwardly turned flange portion 4*h* provided on the open end of the armature cup 4*c*, and a similar flange portion 4*i* provided on the outwardly extending end of the armature 4*e*, whereby the armature 4*e* and associated valve head 4*f* are normally biased outwardly from the coil 4*a*. To complete the structure of the ASCO solenoid valve, a longitudinally extending slot 4*j* is provided in the armature 4*e* so that any water accumulating in the cup 4*c* during use does not prevent or impede the reciprocation of the armature 4*e* in the cup 4*c***.

A cylindrical cup member 9 is mounted within the adaptor 1 and has its open end in sealing engagement with the solenoid frame **4*b*, by its inner bore being in sealing engagement with the outer periphery of seal 4*d*. The outer cylindrical side wall of cup member 9 is in sealing engagement with the inner surface of the cylindrical adaptor by the pair of O-rings 10. The bottom wall 9*a* of the cup member is formed with an integral valve seat portion 9*b* and an integral nozzle flow direction member 9*c* having a tapered nose portion 9*d*, engaging a correspondingly configured inner surface on the nozzle portion 6. A plurality of canted, radially extending slots 9*e* (FIGS. 2 and 3) are formed in the tapered nose portion 9d so that a vortical flow is imparted to the water spray 11 as it flows through the nozzle aperture 6a**.

The bottom wall 9a of the cup 9 is provided with a water passage 9f which extends axially from the valve seat 9b to a transversely extending water passage 9g formed in the flow direction member 9c.

The needle 7 is secured at one end to the valve head 4f and extends therefrom through the axial water passage 9f, a small guide bore 9h formed in the flow direction member 9c, and through the nozzle aperture 6a. There is only approximately one thousandths of an inch difference in the diameters of the needle 7 and guide bore 9h, so that for all practical purposes, no water passes through guide bore 9b and its sole function is to guide needle 7 as it is reciprocated by the armature of the solenoid. To further prevent the entrance of dirt into the nozzle 6, a cylindrical fine wire mesh strainer 12 is positioned within the cup 9 between the bottom wall thereof and the flange 4h of the cup 4c.

Water is supplied to the apparatus through the inlet tube or pipe 8 secured to a nipple 13 fixedly mounted within the adaptor fitting 5, the pipe 8 being held on the nipple 13 by a threaded collar and seal assembly 14. The nipple 13 communicates with an aperture 9i through the side wall of adaptor 1, which communicates with an annular chamber 9j defined by the inner wall surface of the adaptor 1, the outer wall surface of the cup 9 and the pair of spaced O-rings 10. The annular chamber 9j communicates with the interior of the cup 9 through an aperture 9k provided in the cup wall.

In the operation of the embodiment shown in FIGS. 1 to 3, when the solenoid 4 is energized the armature 4e is pulled into the cup 4c, that is, it is moved to the right in FIG. 3, to thereby move the valve head 4f from the closed position on the valve seat 9b, while simultaneously retracting the needle 7 from the orifice 6a, and into the guide bore 9h. Water flows from the inlet 5 through aperture 9i into the annular chamber 9j through aperture 9k, through strainer 12, to axial passage 9f to transverse passage 9g, into chamber 9m, through the slots 9e and outwardly through the nozzle aperture 6a to form the vortical spray 11. When the solenoid is de-energized the spring biases the valve head 4f to the closed position, and the tip of needle 7 moves out of guide passage 9h and extends through the nozzle aperture 6a, as shown in FIG. 3.

Figure 4:
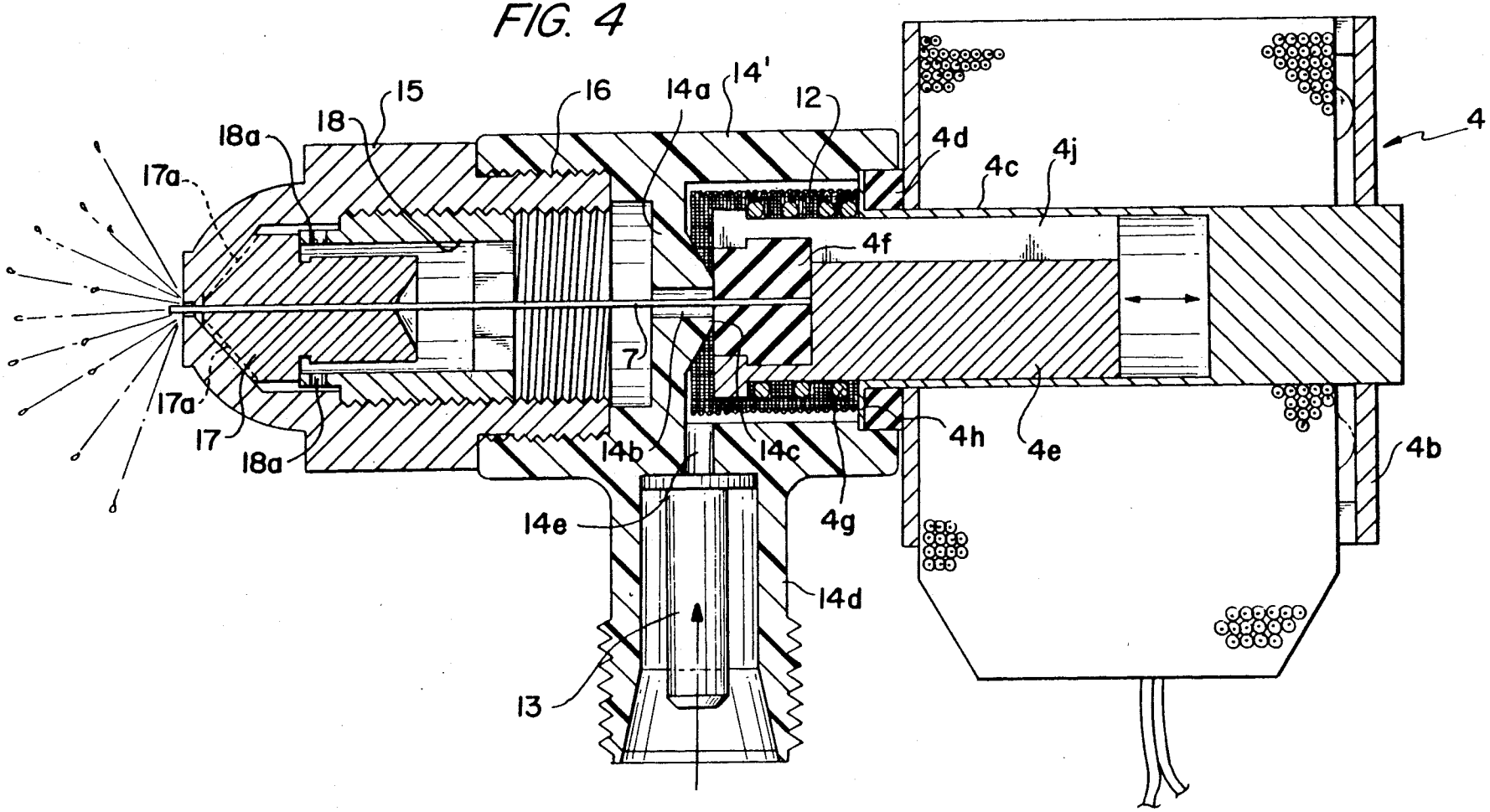
FIG. 4 is a longitudinal sectional view, similar to FIG. 3, of another embodiment of the apparatus of the present invention.

While in the embodiment of FIGS. 1 to 3 the nozzle 6 is integrally formed on the adaptor 1, FIG. 4 illustrates another embodiment of the invention, wherein the adaptor 14' has a nozzle 15 threadably secured thereto as at 16 and containing a separate nozzle flow direction member 17 having a nose configuration similar to that of member 9c. The flow direction member 17 is held in a fixed position within the nozzle 15 by a sleeve 18 threadably mounted in the inner bore of nozzle 15, the sleeve 18 having transverse apertures 18a communicating with the canted slots 17a formed in the flow direction member 17.

The adaptor 14' is provided with a transverse wall 14a having an axial passage 14b extending therethrough, the transverse wall 14a also being provided with a valve seat 14c for the valve head 4f. A water inlet fitting 14d is integrally connected to the side wall of the adaptor and communicates with an aperture 14e formed in the side wall of the adaptor, whereby, when the solenoid valve is actuated, the water flows through the nozzle in a manner similar to the flow as explained in connection with the embodiment shown in FIGS. 1 to 3.

While the adaptor 1, nozzle 6, and flow direction member 9c employed in the embodiment of FIGS. 1 to 3 are formed from molded plastic, the nozzle 15 and flow direction member 17 employed in the embodiment of FIG. 4 are made of stainless steel, but the adaptor 14' is made of plastic. In both embodiments, the adaptors 1 and 14' are connected to the frame 4b of the ASCO solenoid valve by the yoke member 2, and by tightening down on the connecting screws 3 a watertight seal is maintained between the parts, providing a small, compact, versatile, and watertight assembly. Referring to FIG. 1, when required by a particular installation, the adaptor 1 and its integral yoke member 2, and associated nozzle parts may be located on one side of a hole in a mounting wall (not shown), and the solenoid and associated frame 4b can be located on the opposite side of the mounting wall, to sandwich the mounting wall in the spacing shown between yoke 2 and frame 4b when these parts are connected by the mounting screws 3, thus providing a watertight assembly of the parts protruding from opposite sides of the wall. The embodiment shown in FIG. 4 can be mounted in a like manner. The assembly can also be mounted in a variety of positions by mounting frame 4b, by means of screws, to various support members.

From the above description it will be appreciated by those skilled in the art that the apparatus of the present invention provides, in one compact unit, a water spray nozzle having a self cleaning feature and a solenoid controlled valve feature.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

We claim:

1. A self cleaning solenoid controlled water spray nozzle and valve assembly comprising, an adaptor, means for connecting one end of said adaptor to a solenoid, a nozzle having an outlet orifice connected to the opposite end of said adaptor, a nozzle flow direction member mounted within said nozzle, a valve seat mounted within said adaptor, a water inlet fitting connected to said adaptor, water flow passages extending from said water inlet fitting through said adaptor, the valve seat and nozzle flow direction member to the nozzle orifice, said solenoid including a reciprocatory armature, a valve head mounted on one end of said armature and engageable with the valve seat for controlling the flow of water therethrough, and a thin needle connected at one end to said valve head, said needle extending axially from the valve head through the valve seat, the nozzle flow direction member and nozzle orifice to thereby prevent the orifice from becoming clogged by an accumulation of minerals from the spray water, whereby upon actuation of said solenoid the valve head is moved away from the valve seat while simultaneously retracting the free end of the needle from the nozzle orifice, and water is sprayed through the nozzle.

2. The apparatus according to claim 1, wherein the means for connecting the adaptor to the solenoid comprises a yoke secured to said adaptor, the solenoid including a frame, and fastener means securing the yoke to the solenoid frame.

3. The apparatus according to claim 2, wherein the adaptor is formed of molded plastic and the yoke is integrally formed thereon.

4. The apparatus according to claim 3, wherein the water inlet fitting is formed of plastic and is integral with the adaptor.

5. The apparatus according to claim 1, wherein the nozzle is integral with the opposite end of the adaptor.

6. The apparatus according to claim 1, wherein the nozzle is threadably connected to the opposite end of said adaptor.

7. The apparatus according to claim 1, wherein a cup is mounted within said adaptor, said cup having an open end and a bottom wall, the open end of said cup receiving the valve head, the valve seat being integral with the bottom wall of said cup, the nozzle flow direction member being integral with the bottom wall of the cup and extending axially therefrom to the nozzle, the water flow passages including an axial passage extending through the valve seat and bottom wall of the cup communicating with transverse flow passages provided in said flow direction member.

8. The apparatus according to claim 7, wherein a strainer is mounted within said cup.

9. The apparatus according to claim 7, including a pair of seal means connected between said cup and said adaptor and being axially spaced on opposite sides of the water flow passage from said water inlet fitting.

10. The apparatus according to claim 9, in which said pair of seal means are O-ring seal members.

11. The apparatus according to claim 9, in which said cup and said adaptor are spaced concentric to each other, and said water flow passages including another water flow passage through the concentric side of said cup communicating the open end of said cup with the space between said pair of seal means.

12. The apparatus according to claim 1, wherein the adaptor comprises a cylindrical member having a transverse wall, an axial flow passage extending through said wall, and the valve seat formed on the transverse wall adjacent one end of said axial flow passage.

13. The apparatus according to claim 1, in which said valve seat is on a transverse wall, and a strainer is positioned within said adaptor on the valve seat side of the transverse wall.

14. A self cleaning spray nozzle and valve assembly comprising, a nozzle having a discharge orifice, a nozzle flow direction member positioned within the nozzle, said flow direction member having a tapered nose portion engaging a correspondingly configured surface in the nozzle, a plurality of canted, radially extending slots formed in the tapered nose portion communicating with the nozzle orifice, a moveable cleaning pin adapted to extend through the flow direction member and nozzle orifice and to protrude therefrom, an adaptor having a water inlet and an outlet aligned with the nozzle and flow direction member, the adaptor outlet adapted to admit water under pressure into the flow direction member and nozzle, an actuator, means for connecting said adaptor to said actuator, a plunger connected for movement by said actuator between a forward position and a retracted position, said plunger having the cleaning pin mounted thereon, and a valve head mounted on said plunger for closing the adaptor outlet when the plunger is in the forward position and which opens the adaptor outlet when the plunger is in a retracted position, and spring means engaging said actuator for biasing the valve head to the closed position when the actuator is inactivated.

* * * * *